US011441815B2

(12) United States Patent
Vega

(10) Patent No.: US 11,441,815 B2
(45) Date of Patent: Sep. 13, 2022

(54) SYSTEMS AND METHODS FOR HEATER CONTROL IN FLUID HEATING SYSTEMS

(71) Applicant: Rheem Manufacturing Company, Atlanta, GA (US)

(72) Inventor: David I. Vega, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 22 days.

(21) Appl. No.: 16/849,403

(22) Filed: Apr. 15, 2020

(65) Prior Publication Data

US 2021/0325086 A1 Oct. 21, 2021

(51) Int. Cl.

| | |
|---|---|
| ***F24H 9/20*** | (2022.01) |
| ***F24H 1/12*** | (2022.01) |
| ***F24H 15/18*** | (2022.01) |
| ***F24H 15/128*** | (2022.01) |
| *F24H 1/10* | (2022.01) |

(52) U.S. Cl.

CPC ..... *F24H 9/2028* (2013.01); *F24H 1/121* (2013.01); *F24H 1/124* (2013.01); *F24H 9/2035* (2013.01); *F24H 15/128* (2022.01); *F24H 15/18* (2022.01); *F24H 1/107* (2013.01)

(58) Field of Classification Search

CPC .... F24D 2220/04; F24H 9/2028; F24H 1/121; F24H 1/124; F24H 9/2035; F24H 1/107; F24H 1/46; F24H 3/0405; F24H 1/12; F24H 1/165; F24H 15/128; F24H 15/18; F24H 15/288; F24H 15/37

USPC ..... 122/14.2

See application file for complete search history.

(56) References Cited

U.S. PATENT DOCUMENTS 3,201,045 A * 8/1965 Davidson ..... F24H 1/12 237/8 R
3,828,737 A * 8/1974 Fujii ..... F22B 35/10 122/451 S (Continued)

FOREIGN PATENT DOCUMENTS

CN 210425531 U 4/2020
DE 10062936 A1 6/2002

(Continued)

OTHER PUBLICATIONS

International Search Report and Written Opinion for PCT Application No. PCT/US2021/027187 dated Jul. 15, 2021.

*Primary Examiner* — Steven S Anderson, II
*Assistant Examiner* — Andrew W Cheung
(74) *Attorney, Agent, or Firm* — Eversheds Sutherland (US) LLP

(57) ABSTRACT

The disclosed technology includes systems and methods for controlling a water heater. The disclosed systems can be configured to receive temperature data from a temperature sensor, receive flow rate data from a flow rate sensor, and receive a temperature setting. The systems can calculate a heat load rate based on at least the temperature data, the flow rate data, and the temperature setting, and can compare the heat load rate to a predetermined threshold setting. The systems can output instructions to perform a fast corrective action in response to the determination that the heat load is changing at a rate (i.e. the heat load rate) greater than, less than, or equal to the predetermined threshold setting.

20 Claims, 4 Drawing Sheets

(56) References Cited

U.S. PATENT DOCUMENTS 4,064,698 A * 12/1977 Stern ..... F23N 1/08 122/448.1
4,550,689 A * 11/1985 Wolter ..... F23N 5/082 122/18.4
4,852,524 A * 8/1989 Cohen ..... F24H 8/00 122/15.1
5,442,157 A * 8/1995 Jackson ..... F24H 9/2035 219/508
5,866,880 A * 2/1999 Seitz ..... G05D 23/1917 219/486
6,445,880 B1 * 9/2002 Hollander ..... F24H 1/102 392/485
6,694,927 B1 * 2/2004 Pouchak ..... F23N 1/082 219/508
6,798,341 B1 * 9/2004 Eckel ..... G01K 1/045 340/517
7,798,107 B2 * 9/2010 Chian ..... F24H 9/2021 122/14.22
8,371,252 B1 * 2/2013 Paine ..... F22B 35/008 122/448.3
8,757,509 B2 * 6/2014 Anderson ..... F24H 9/2035 122/504
9,310,813 B2 * 4/2016 Farris ..... G05D 23/1366
9,651,955 B2 * 5/2017 Kulkarni ..... F24H 9/2035
2010/0004786 A1 * 1/2010 Paine ..... F23N 1/082 700/275
2011/0004423 A1 * 1/2011 Iwamoto ..... F23N 5/24 702/47
2011/0041781 A1 * 2/2011 Deivasigamani ..... F24H 1/165 165/184
2012/0060827 A1 * 3/2012 Roetker ..... F24H 9/2035 126/587
2013/0081581 A1 * 4/2013 Cook ..... F24H 9/2035 122/14.21
2014/0241708 A1 * 8/2014 Chaudhry ..... F24H 9/2021 392/454
2015/0096504 A1 * 4/2015 Ando ..... F24H 9/2035 122/14.2
2016/0047558 A1 * 2/2016 Shimada ..... F24D 3/02 237/63
2019/0024908 A1 * 1/2019 Chaudhry ..... F24H 9/2021

FOREIGN PATENT DOCUMENTS

GB 2358971 A 8/2001
RU 200983 U1 11/2020
WO 2006/038109 A2 4/2006
WO WO-2007109829 A1 * 10/2007 ..... F24H 9/2007

* cited by examiner

SYSTEMS AND METHODS FOR HEATER CONTROL IN FLUID HEATING SYSTEMS

FIELD OF THE DISCLOSURE

The present disclosure relates generally to fluid heater systems. Particularly, the present disclosure relates to water heater control systems and methods.

BACKGROUND

Typically, in a so-called tankless water heater, the water is heated on-demand. Commonly, these tankless water heaters have a staged burner system, which can ignite in stages to match the demand of heated water. These systems can have a large thermal inertia, and when there is a sudden drop in water demand, the thermal inertia and a slow control response can result in the burner system continuing to heat at a rate that is now too high for the lower demand of heated water, thus heating the water to unsafe temperatures. For example, such scenarios can provide a user with scalding hot water, damage the plumbing, or even accelerate on the tankless water heater and/or its components.

Thus, it would be advantageous to have methods and systems that can quickly react to changes in demand that can also mitigate temperature over-shoots in tankless water heaters while delivering the requested water demand to the user.

SUMMARY

These and other problems can be addressed by the technology disclosed herein. The disclosed technology can help prevent temperature over-shoots in water heaters (e.g., tankless water heaters) while delivering the requested water demand to the user. Further, the disclosed technology can provide additional benefits as will be discussed herein and as will become apparent to those having skill in the art.

The disclosed technology includes a controller for use with a water heater, and the controller can have one or more processors and memory. The memory can store instructions and settings for the water heater, such as a temperature setting and predetermined threshold setting. When executed, the computer executable instructions can cause the one or more processors to receive sensor data from one or more sensors of the water heater, and the sensor data can include a current data value and at least one previous data value. The one or more sensors can include a temperature sensor configured to measure temperature of a fluid and/or a flow sensor configured to detect flow of a fluid. Accordingly, the sensor data can include temperature data (i.e., from one or more temperature sensors) and/or flow rate data from a flow sensor. The instructions can cause the one or more processors to determine a change rate based on at least the current data value and the at least one previous data value. Comparing the change rate to the predetermined threshold settings can include normalizing the sensor data (e.g., temperature data, flow rate data), calculating a derivative of the normalized sensor data to determine a normalized change rate, and comparing the normalized change rate to a predetermined normalized threshold setting. Alternatively, the derivative can be calculated based on non-normalized sensor data to determine a change rate. The instructions can cause the one or more processors to output the instructions to perform the corrective action in response to determining that the change rate exceeds (or alternatively, is greater than or equal to) the predetermined threshold setting or in response to determining that the normalized change rate exceeds (or alternatively, is greater than or equal to) the predetermined normalized threshold setting. The predetermined threshold setting (or predetermined normalized threshold setting) can be associated with a flow rate threshold setting when the sensor data is flow rate data. The predetermined threshold setting (or predetermined normalized threshold setting) can be associated with a temperature change threshold setting when the sensor data is temperature data. The corrective action of the heating device can include decreasing heat output from the heating device. Further, decreasing heat output from the heating device can include one or more of: extinguishing one or more burners, or reducing the flame height of the one or more burners, deactivating one or more electric coils, or reducing the duty cycle of the one or more electric coils.

The disclosed technology includes a method for controlling a water heater. The method can include receiving temperature data from a temperature sensor configured to measure fluid temperature at a fluid inlet, receiving flow rate data from a flow rate sensor configured to measure flow rate at the fluid inlet, and receiving a temperature setting. Further, the method can include calculating a heat load rate based on at least the temperature data, the flow rate data and the temperature setting, and comparing the heat load rate to a predetermined threshold setting. Comparing the heat load rate to the predetermined threshold setting can include normalizing the temperature data and/or flow rate data to determine a normalized heat load rate, and comparing the normalized heat load rate to a predetermined normalized threshold setting. The method can include outputting instructions to perform a corrective action in response to the determination that the heat load rate exceeds (or alternatively, is greater than or equal to) the predetermined threshold setting. The corrective action of the heating device include decreasing heat output from the heating device. Further, decreasing heat output from the heating device can include one or more of: extinguishing one or more burners, or reducing the flame height of the one or more burners, deactivating one or more electric coils, or reducing the duty cycle of the one or more electric coils. The corrective action can be a first corrective action and the method can include receiving new temperature data from the temperature sensor, and new flow rate data from the flow sensor from the temperature sensor. Based on at least the new temperature data and the new flow rate data, the method can calculate a new heat load rate. The method can further include determining that the new heat load rate is greater than the predetermined threshold setting; and outputting instructions to perform a second corrective action in response to the determination that the new heat load rate is greater than the predetermined threshold setting.

The disclosed technology includes a tankless water heater including a water inlet, one or more heating devices disposed proximate a heat exchanger, a temperature sensor, a flow rate sensor, and a controller. The temperature sensor can be disposed at the water inlet and can be configured to measure temperature at the water inlet. The flow rate sensor can be disposed at the water inlet and can be configured to measure fluid flow at the water inlet, and a controller. The controller can include one or more processors memory storing instructions, a predetermined threshold setting, and a temperature setting. The instructions when executed by the one or more processors can cause the controller to receive temperature data from a temperature sensor, receive flow rate data from a flow rate sensor, and receive a temperature setting. The instructions can cause the controller to calculate a heat load rate based on at least the temperature data, the flow rate data, and the temperature setting, and the instructions can cause the controller to compare the heat load rate to a predetermined threshold setting. Comparing of the heat load rate to the predetermined threshold can include normalizing the temperature data and/or flow rate data to determine a normalized heat load rate and comparing the normalized heat load rate to a predetermined normalized threshold setting. The instructions can cause the controller to output instructions to perform a corrective action in response to the determination that the heat load rate exceeds (or alternatively, is greater than or equal to) the predetermined threshold setting. The corrective action can include one or more of: extinguishing one or more burners, reducing the flame height of the one or more burners, deactivating one or more electric coils, or reducing the duty cycle of the one or more electric coils. The corrective action can be a first corrective action and the instructions can further cause the controller to receive new temperature data from the temperature sensor, and receive new flow rate data from the flow rate sensor. Further, the instructions can cause the controller to calculate a new heat load rate based on at least the new temperature data, new flow rate data and the temperature setting. The instructions can cause the controller to determine that the new heat load rate is greater than the predetermined threshold setting, and output instructions to perform a second corrective action in response to the determination that the new heat load rate is greater than the predetermined threshold setting.

Other implementations, features, and aspects of the disclosed technology are described in detail herein and are considered a part of the claimed disclosed technology and can be understood with reference to the following detailed description, accompanying drawings, and claims.

BRIEF DESCRIPTION OF THE FIGURES

Reference will now be made to the accompanying figures and flow diagrams, which are not necessarily drawn to scale.

DETAILED DESCRIPTION

Figure 1:
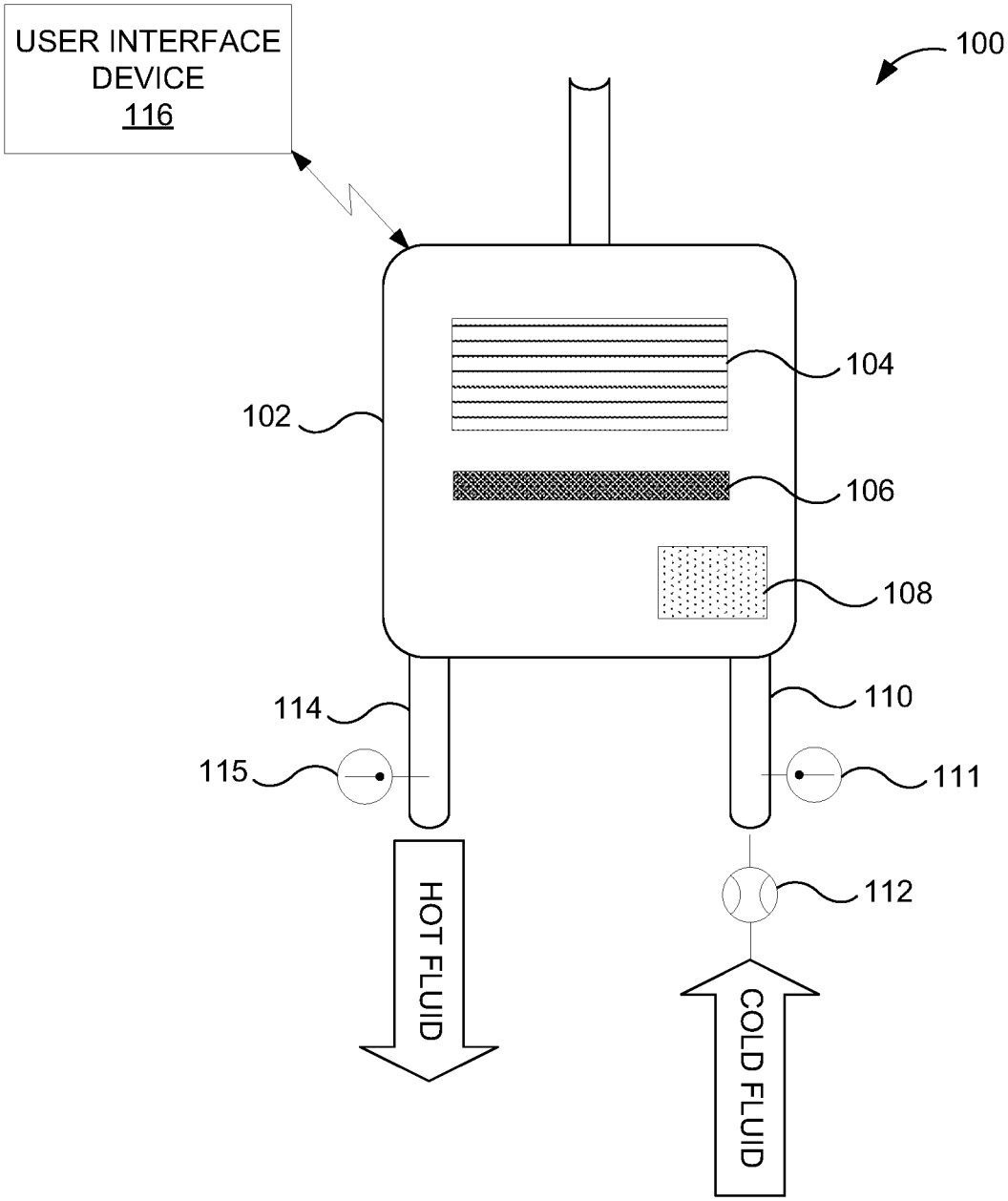
FIG. 1 illustrates a schematic of an example tankless water heater system, in accordance with the disclosed technology.

As described above, tankless water heaters heat water on-demand and commonly have a staged burner system that can ignite in stages to provide sufficient energy to heat water to a requested temperature. These systems can have a large thermal inertia, and should a sudden decrease in water demand occur, the thermal inertia can result in the burner system continuing to heat at the same rate, which is now too high for the lower water demand, thus heating the water to unsafe temperatures. This can result in scalding hot water being delivered to the user and/or can damage the plumbing or accelerate wear on the water heater and/or its components.

The disclosed technology includes systems and methods for preventing or mitigating temperature overshoot in a fluid (e.g., water) heating system. For example, the disclosed technology includes a controller configured to receive sensor data from a sensor of the water heater, and the sensor data can include a current data value and at least one previous data value. The controller can be configured to determine a change rate of the sensor data. The controller can be configured to normalize the sensor data, compute a derivative of the normalized sensor data to determine a normalized change rate. The controller can be configured to compare the change rate to a predetermined threshold setting or compare the normalized change rate to a predetermined normalized threshold setting, and based on the comparison, the controller can be configured to output instructions to perform a corrective action. The controller can be configured to output instructions to perform a fast corrective action. For example, the corrective action can be performed (or at least initiated) in real-time or substantially in real-time as receipt of the sensor data from the sensor. As used herein, the term "substantially in real-time" can refer to an amount of time associated with a minimal delay corresponding to a standard computing device receiving data, processing the data, and outputting instructions associated with the data (e.g., in a range between approximately 6 milliseconds and approximately 20 milliseconds, in a range between approximately 20 milliseconds and approximately 100 milliseconds).

While it may be possible to reduce the effect of temperature overshoot by adding cold water to the heated water downstream of the heating device, such a method can undesirably increase the flow rate or amount of water outputted, can decrease the temperature of water by an incorrect temperature (i.e., decrease the temperature too much or not enough), can decrease the temperature of water only after exceedingly heated water has already been provided to the user, and/or can require additional components, such as additional valves, piping, tubing, or other hardware.

As will be appreciated, the disclosed technology can provide several advantages, which can include prevention or mitigation of temperature overshoot in various water heating applications. Further, the disclosed technology can do so with minimal hardware or without additional hardware altogether, which can provide a simple and inexpensive solution to the problems addressed herein. Further still, the disclosed technology can prevent or mitigate temperature overshoot without influencing or affecting the flow rate or amount of heated water outputted by the heating system. These and other benefits will be realized in accordance with the discussion and examples provided herein.

Throughout this disclosure, certain examples are described in relation to water heater control systems and methods. But the disclosed technology is not so limited. The disclosed technology can be used in other fluid heating systems (e.g., other than water). For example, the disclosed technology can be used in fluid heating systems using gaseous fuel (e.g., natural gas, propane), liquid fuels (e.g., diesel, kerosene), electric heating systems, or any other fluid heating system where temperature overshoot is possible. It is to be understood that the disclosure is limited in its scope to the details of construction and arrangement of components set forth in the following description or illustrated in the drawings, and various aspects of the disclosed technology can be practiced or carried out in various ways. Also, in describing the technology, specific terminology will be resorted to for the sake of clarity. It is intended that each term contemplates its broadest meaning as understood by those skilled in the art and includes all technical equivalents which operate in a similar manner to accomplish a similar purpose.

Some implementations of the disclosed technology will be described more fully hereinafter with reference to the accompanying drawings. This disclosed technology can, however, be embodied in many different forms and should not be construed as limited to the implementations set forth therein.

In the following description, numerous specific details are set forth. But it is to be understood that implementations of the disclosed technology may be practiced without these specific details. In other instances, well-known methods, structures, and techniques have not been shown in detail in order not to obscure an understanding of this description. References to "one implementation," "an implementation," "example implementation," "some implementations," "certain implementations," "various implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

Further, unless otherwise specified, any ranges of values disclosed herein are inclusive of the stated endpoints. For example, a range of values between 3 and 8 would include the values 3 and 8, as well as the values between 3 and 8.

As illustrated in FIG. 1, an example tankless water heater 100 can comprise a housing 102, a heat exchanger 104, a heating device 106, a controller 108, a fluid inlet 110 (e.g., water inlet), an inlet temperature sensor 111 (e.g., thermocouple, thermistor, thermometer, piezoelectric sensor), a flow sensor 112 (e.g., piston flow meter, oval gear flow meter, gear flow meter, helical gear flow meter, turbine flow meter, Woltman meter, single jet meter, multiple jet meter, paddle wheel meter, Pelton wheel turbine, Venturi meter, Dall tube, multi-hole pressure probe, orifice plate, cone meter, laminar flow meter, variable-area flowmeter, optical flow meter), a fluid outlet 114, an outlet temperature sensor 115 (e.g., the same type of temperature sensor as the inlet temperature sensor 112, a type of temperature sensor different from the inlet temperature sensor 112), and/or a user interface device 116 (e.g., a thermostat) configured to receive user-inputted temperature settings and communicate with the controller 108, heating device 106, or any other component of the water heater 100. The housing 102 can be configured to contain or include the heat exchanger 104, the heating device 106, and/or the controller 108.

The heat exchanger 104 can be in thermal communication with the heating device 106 and can be configured to receive fluid from the fluid inlet 110. The heat exchanger 104 can be configured to transfer heat from the heating device 106 to the fluid. Additionally, the heat exchanger 104 can be configured to release or provide fluid (e.g., heated fluid) to the fluid outlet 114. The heat exchanger 104 can be located within the housing 102. The heat exchanger 104 can be constructed from aluminum, copper, stainless steel, any alloys thereof, or the like.

The heating device 106 can be configured to receive fuel from a fuel source and combust the fuel to output heat. Additionally or alternatively, the heating device 106 can be configured to receive electric current from a power source and energize heaters to output heat. The heating device 106 can be configured to transfer heat to the heat exchanger 104. As non-limiting examples, the heating device 106 can be or include one or more burners, a staged burner, one or more resistive coils, one or more electric coils, one or more radiative heating tubes, or the like. The heating device 106 can be located within the housing 102, and the heating device 106 can be constructed from aluminum, copper, stainless steel, any alloys thereof, or the like. The heating device 106 can be ignited, excited, extinguished, disengaged, or turned off as appropriate and understood by one of skill in the art.

For example, the controller 108 can in electrical communication with the heating device 106 and be configured to ignite, excite, extinguish, disengage, or turn off the heating device 106 or one or more portions or sections thereof. The controller 108 can be located within the housing 102. Alternatively, the controller 108 can be located remotely with respect to the water heater 100. For example, the controller 108 can be a cloud-based controller, which can be provided by a remote server or server system, for example. The controller 108 can be in electrical communication with one or more of the heating device 106, the inlet temperature sensor 111, and the flow sensor 112. The controller 108 can be in electrical communication with one or more sensors, the outlet temperature sensor 115. The controller can also be in electrical communication with a user interface device 116 or thermostat associated with the water heater 100. Additionally or alternatively, the controller can be configured to send and/or receive data from one or more of the heating device 106, the inlet temperature sensor 111, the flow sensor 112, and the outlet temperature sensor 115.

The controller 108 can include one or more processors and memory. The processor can include one or more of a microprocessor, microcontroller, digital signal processor, co-processor or the like or combinations thereof capable of executing stored instructions and operating upon stored data. The processor can be one or more known processing devices, such as a microprocessor from the Pentium™ family manufactured by Intel™ or the Turion™ family manufactured by AMD™. The processor can constitute a single core or multiple core processor that executes parallel processes simultaneously. For example, the processor can be a single core processor that is configured with virtual processing technologies. In certain embodiments, the processor can use logical processors to simultaneously execute and control multiple processes. The processor can implement virtual machine technologies, or other similar known technologies to provide the ability to execute, control, run, manipulate, and/or store, multiple software processes, applications, programs, and the like. One of ordinary skill in the art would understand that other types of processor arrangements could be implemented that provide for the capabilities disclosed herein.

The memory can include one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like) for storing files including an operating system, application programs, executable instructions, and data. As will be appreciated, the memory can store instructions that, when executed by one or more processor, cause the controller 108 to perform at least some of the functionality and methods described herein.

The controller 108 can include a communication module that can be configured to transmit and receive data. The communication module can be configured to communicate with various devices via wired or wireless communication. As non-limiting examples, controller 108 can communicate with the thermostat or user device via a direct connection such as radio-frequency identification (RFID), near-field communication (NFC), Bluetooth™, low-energy Bluetooth™ (BLE), WiFi™, ZigBee™, ambient backscatter communications (ABC) protocols, USB, WAN, or LAN. The communication module can be configured to communicate with some or all of the various sensors and/or components of the water heater 100, and/or the communication module can be configured to communicate with one or more remote devices, such as the user interface device 116 or a thermostat associated with the water heater 100. The communication module can be configured to communicate with one or more devices via a network (e.g., the internet, a local area network).

The fluid inlet 110 can be configured to receive fluid from a fluid source and discharge the fluid into the heat exchanger 104, and the fluid outlet 114 can be configured to receive fluid from the heat exchanger 104 and discharge the fluid for subsequent use. The fluid inlet 110 and/or the fluid outlet 114 can be a copper pipe, PVC pipe, or the like.

The inlet temperature sensor 111 can be disposed in or proximate the fluid inlet 110 and can be disposed in communication with incoming fluid. The outlet temperature sensor 115 can be disposed in or proximate the fluid outlet 114 and be in communication with the exiting fluid. The inlet temperature sensor 111 and/or the outlet temperature sensor 115 can be configured to detect the temperature of the fluid and transmit temperature data to the controller 108. The temperature data can be indicative of the detected fluid temperature. The temperature sensors 111, 115 can be mechanical or electrical. For example, the temperature sensor 111 and/or the temperature sensor 115 can be a thermometer (e.g., mercury-based thermometers), bimetallic strip (e.g., brass and steel strips), thermistor, thermistor, silicon bandgap temperature sensor, resistance thermometer, piezoelectric sensor, or the like. The temperature sensors 111, 115 can be the same type of temperature sensor or can be different types of temperature sensors.

The flow sensor 112 can be configured to detect flow of the fluid and transmit flow rate data to the control 108. The flow rate data can be indicative of the detected fluid flow rate. The flow sensor 112 can be located at or near the fluid inlet 110, at or near the fluid outlet 114, within the heat exchanger 104, or in any other location associated with the water heater 100 through which fluid can flow. As non-limiting examples, the flow meter 112 can be or include a mechanical flowmeter (e.g., paddle wheel meter), pressure-based flowmeter (e.g., pitot-tube), variable-area flowmeter (e.g., rotameter), optical flowmeter (e.g., laser doppler flow measurement), thermal mass flowmeter (e.g., MEMS sensor), electromagnetic flowmeter, ultrasonic flowmeter, or the like. As further examples, the flow sensor 112 can be or include a flow sensor or a flow analyzer.

The user interface device 116 can be configured to transmit temperature settings to the controller 108 and/or otherwise communicate with the controller 108 and/or one, some, or all of the components of the water heater 100. The user interface device 116 can include a computing device, a mobile device, or any other device configured to receive user input (e.g., temperature settings) and/or communicate with the controller 108 or various components of the water heater 100. The user device 116 can include a smart thermostat application configured to receive user input (e.g., temperature settings), display data associated with the water heater 100, and/or communicate with the controller 108 and/or various components of the water heater 100. Likewise, the user interface device 116 can include a smart thermostat (e.g., internet of things (IoT) device installed in a home and configured to communicate with the water heater 100). Alternatively, the user interface device 116 can include a traditional thermostat (i.e., a thermostat that is not "smart"). The user interface device 116 (e.g., mobile device, computing device, user device, smart thermostat, traditional thermostat) can be configured to provide some or all of the functionality or other aspects of controller 108.

Figure 2:
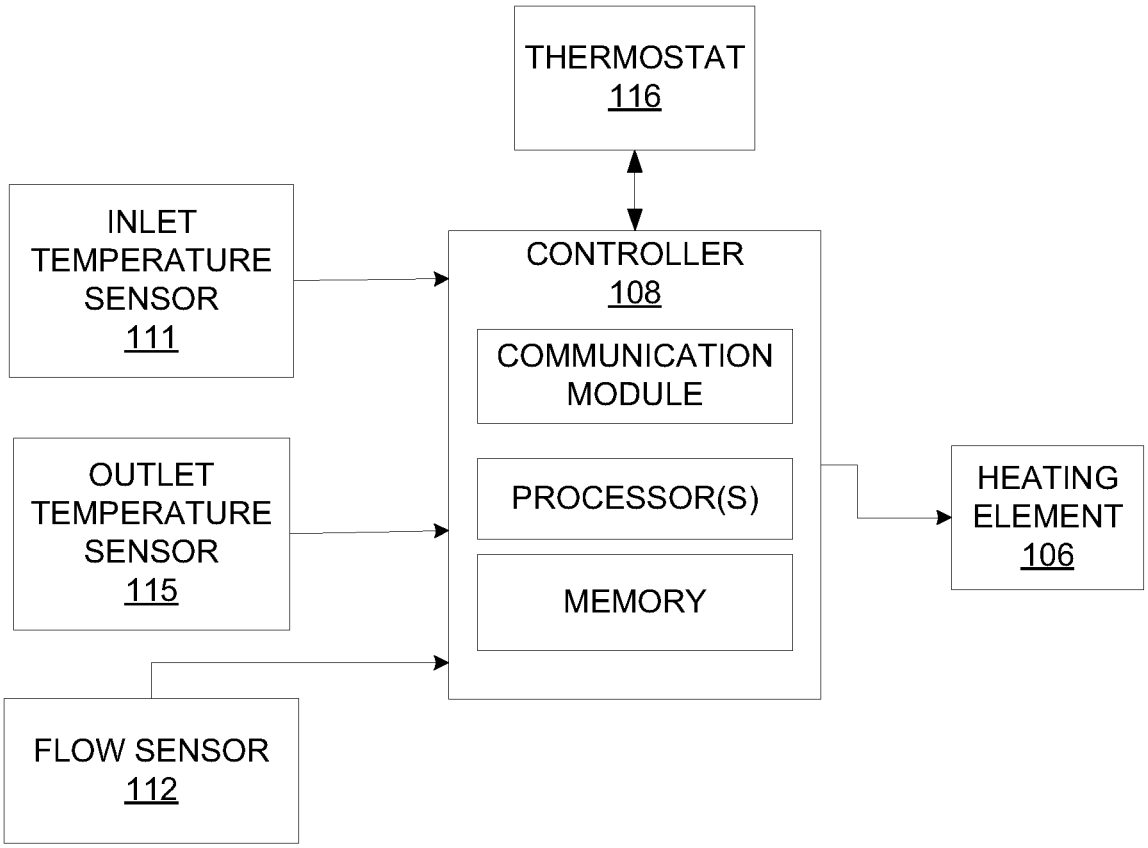
FIG. 2 illustrates a schematic of an example water heater controller, in accordance with the disclosed technology.

FIG. 2 is a diagram representing the controller 108 in communication with the heating device 106, the inlet temperature sensor 111, the flow sensor 112 and the thermostat 116. As will be appreciated, the disclosed technology includes systems and devices that include one, some, or all of the components depicted in FIG. 2. For example, the disclosed technology can include a system without an inlet temperature sensor 111. As another example, the disclosed technology can include a system without an outlet temperature sensor 115. As another example, the disclosed technology can include a system without a flow sensor 112. Alternatively, the disclosed technology can include systems and devices that include additional components not depicted in FIG. 2.

Figure 3:
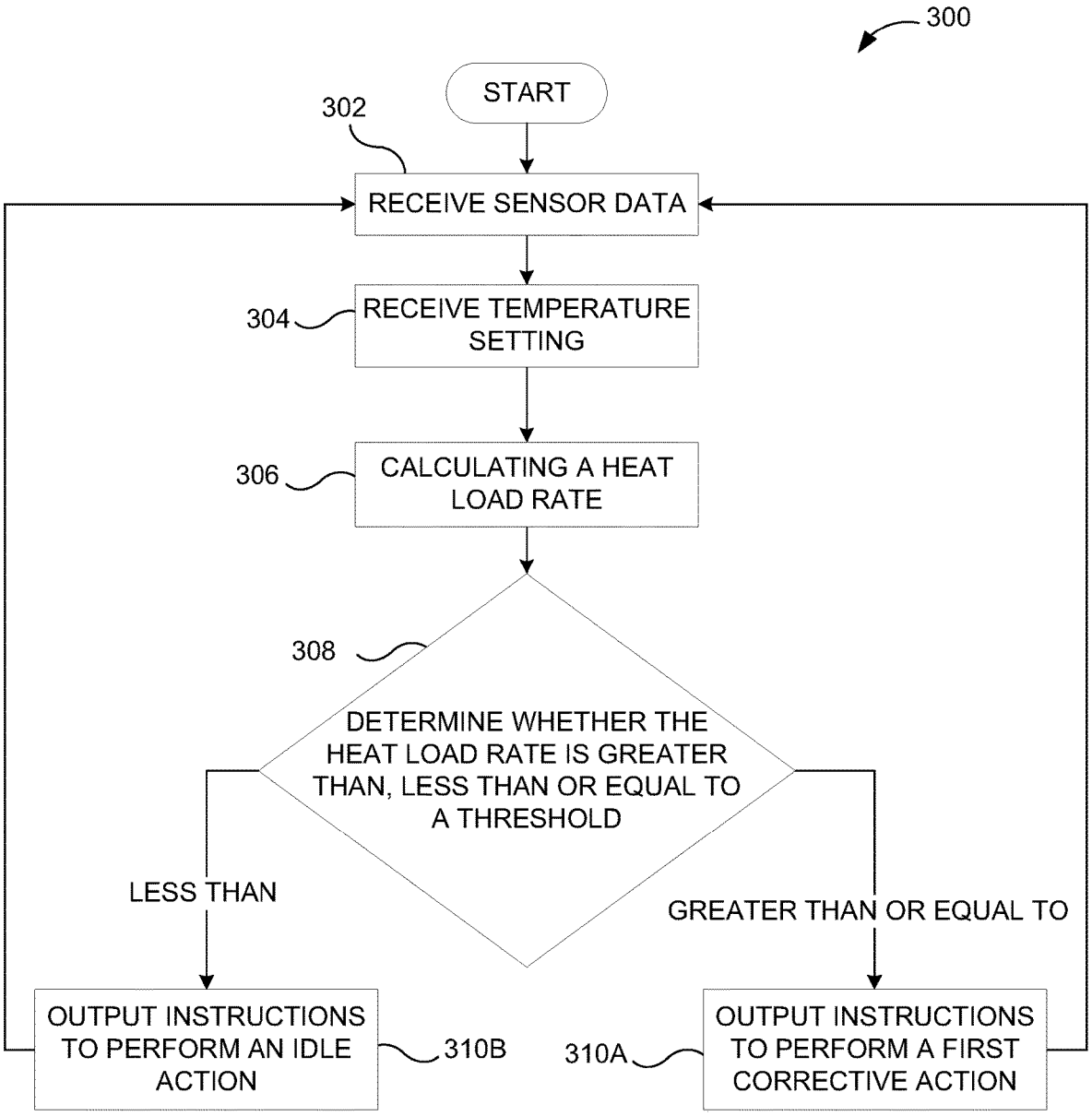
FIG. 3 illustrates an example method for controlling water temperature overshoot, in accordance with the disclosed technology.

FIG. 3 provides a diagram illustrating an example method 300 for controlling temperature overshoot in a water heater 100 (e.g., a tankless water heater). As will be appreciated, the method 300 can be performed by the controller 108, the user interface device 116, or another computing device.

The method 300 can include receiving 302 temperature data (e.g., from the inlet temperature sensor 111 and/or the outlet temperature sensor 115) and flow rate data (e.g., from the flow meter 112). If sensor data of the same type is received from multiple sensors (e.g., temperature data is received from both the inlet temperature sensor 111 and/or the outlet temperature sensor 115), the method can include calculating an average, a weighted average, or some other statistical analysis of the received sensor data. The temperature data and flow rate data can be sampled at the same frequency. Alternatively, the temperature data and flow rate data can be sampled at different frequencies. The method 300 can include filtering the temperature data and/or the flow rate data to remove noise and/or anomalies from the data. The filtering can be done by a variety of known methods, such as via a bandpass filters, Fast-Fourier transforms, moving averages, or the like.

The method 300 can include receiving 304 a temperature setting (e.g., from the user interface device 116). The temperature setting can be a single value. Alternatively, the temperature setting can be a range of values. Alternatively, the received temperature setting can be a single value, and the method can include determining a range of values based on the received single value. For example, the method can include receiving a temperature setting (e.g., 72.0° F.) and applying a tolerance range (e.g., ±0.5° F.) to determine a temperature setting having a range of between 71.5° F. and 72.5° F. The method can include storing the temperature setting in memory (e.g., local memory, remotely located memory).

The method 300 can include calculating 306 a heat load rate. The calculation can be based on at least the temperature data, the flow rate data, and the temperature setting. The calculation can optionally include system constants that can be unique to each water heater. Additionally or alternatively, the system constants can be unique to each water heater model. The calculation can further include system variables that can be unique to each water heater and/or each water heater model.

The method 300 can include comparing 308 the heat load rate to a predetermined threshold setting (i.e., determining whether the heat load rate is greater than, less than, or equal to a predetermined threshold setting). The predetermined threshold setting can be a predetermined value. The predetermined value can be unique to each water heater model and/or to each water heater.

Additionally or alternatively, the method 300 can include normalizing the temperature data and/or flow rate data to determine a normalized heat load rate and comparing the normalized heat load rate to a predetermined normalized threshold setting. The normalization can be performed using feature scaling (e.g., mean normalization, min-max rescaling, z-score normalization and/or scaling to a unit basis). As non-limiting examples, the heat load rate can be normalized on a scale of 0 to 1, 0 to 100, or any other scale. The normalized heat load rate can be compared to a predetermined normalized threshold setting. As non-limiting examples, the predetermined normalized threshold settings can be approximately 50% of the normalized scale, approximately 70% of the normalized scale, approximately 75% of the normalized scale, approximately 80% of the normalized scale, approximately 85% of the normalized scale, approximately 90% of the normalized scale, or any other percentage of the normalized scale (e.g., any percentage between approximately 50% of the normalized scale and approximately 90% of the normalized scale, between approximately 60% of the normalized scale and approximately 80% of the normalized scale). The predetermined normalized threshold setting can be a predetermined value on the normalized scale and/or a predetermined percentage of the normalized scale. The method 300 can include repeating the comparison of the heat load rate (using updated heat load rate information) to the predetermined threshold setting once approximately every 0.1, 0.25, 0.5, 0.75 1, 2, 3, 4, 5, or 10 seconds while the fluid is flowing through the fluid inlet 110, the fluid outlet 114, and/or the heat exchanger 104.

The method 300 can include outputting instructions according to whether the heat load rate is greater than, less than, or equal to the predetermined threshold setting (or whether the normalized heat load rate is greater than, less than, or equal to a predetermined normalized threshold setting).

For example, in response to determining that the heat load rate is greater than or equal to the predetermined threshold setting (or the normalized heat load rate is greater than or equal to the predetermined normalized threshold setting), the method 300 can include outputting 310A instructions for a heating device (e.g., heating device 106) to perform a corrective action. As another example, in response to determining that the heat load rate is less than the predetermined threshold setting (or the normalized heat load rate is less than the predetermined normalized threshold setting), the method 300 can include outputting 310B instructions for a heating device (e.g., heating device 106) to maintain current settings.

Outputting 310A instructions to perform a corrective action (e.g., a first corrective action) can include transmitting instructions to the heating device 106. The instructions associated with the corrective action can instruct the heating device 106 to decrease its heat output. For example, the instructions can instruct the heating device 106 to extinguish one or more burners (e.g., if the heating device is a staged burner device), reduce the flame height of one or more burners, deactivate one or more electric coils, reduce the duty cycle of the one or more electric coils, or perform any other action that would cause the heating device 106 to decrease its heat output. Additionally or alternatively, the instructions to perform a corrective action (e.g., a first corrective action) can include instructions for the heating device 106 or a separate device to implement, insert, extend, or otherwise introduce a barrier or other heat transfer impediment that can be configured reduce the transfer of heat from the heating device 106 to the heat exchanger 104 and/or fluid. For example, the instructions can instruct the heating device 106 or another device to place a heat shield between the heating device 106 and the heat exchanger 104.

Additionally or alternatively, the instructions to perform a corrective action can include instructions to increase the fluid flow rate through the heating device 106 and/or releasing or providing unheated water downstream of the heat exchanger 104. This may provide a more precise release of unheated water downstream of the heat exchanger 104 as compared to existing systems and/or may enable unheated water to be released only when absolutely needed to prevent temperature overshoot, thus providing water having a more precise or accurate temperature.

As mentioned above, the method 300 can include outputting 310B instructions to maintain the current heat output, and these instructions can be outputted in response to determining that the heat load rate is less than the threshold. For example, the instructions can include one or more of maintaining one or more burners in their respective current states, maintaining the flame height of one or more burners, maintaining one or more electric coils in their respective current states, and/or maintaining the duty cycle of one or more electric coils. Additionally or alternatively, the method 300 can include outputting instructions for the heating device 106 or a separate device to implement, insert, extend, or otherwise introduce a barrier or other heat transfer impediment that can be configured reduce the transfer of heat from the heating device to the heat exchanger 104 and/or fluid. For example, the instructions can instruct the heating device 106 or another device to place a heat shield between the heating device 106 and the heat exchanger 104.

Should the heating device 106 include multiple burner stages (e.g., a staged burner) and/or multiple electric coils, the instructions can instruct the heating device 106 to extinguish, disengage, or deactivate a particular number of burner stages and/or coil elements. As a non-limiting example, the heating device 106 can be a staged burner having five stages. The method 300 can include outputting instructions for the staged burner to decrease the number of ignited stages, and the number by which the staged burned is instructed to decrease the number of ignited stages can depend, at least in part, on the number of stages currently firing. For example, if the staged burner is currently firing three or more stages, the instructions can instruct the burner to decrease the number of firing burners by two; if the staged burner is currently firing two stages, the instructions can instruct the burner to decrease the number of firing burners by one; and if the staged burner is currently firing one stage, the instructions can instruct the burner to continue firing the single or turn off all stages. If only a single stage is firing, the controller 108 can be configured to not transmit instructions to adjust the number of stages firing.

Figure 4:
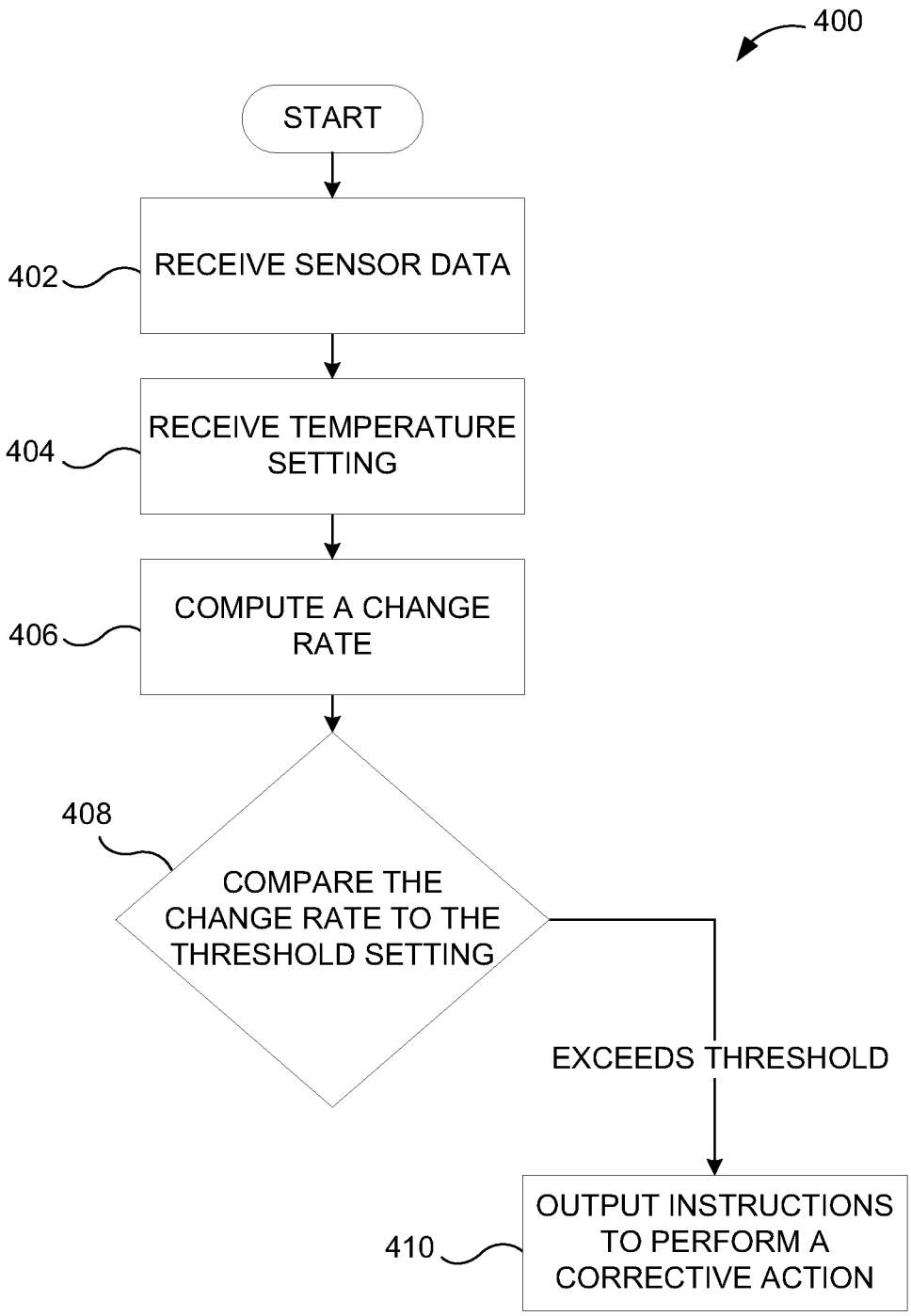
FIG. 4 illustrates an example method for controlling water temperature overshoot, in accordance with the disclosed technology.

FIG. 4 provides a diagram illustrating an example method 400 for controlling temperature overshoot in a water heater (e.g., a tankless water heater). As will be appreciated, the method 400 can be performed by the controller 108, the user interface device 116, or another computing device.

The method 400 can include receiving 402 sensor data at the controller 108. The sensor data can include one or more of: temperature data from the inlet temperature sensor 111, temperature data from the outlet temperature sensor 115, or flow rate data from the flow sensor 112. Regardless of the data type (e.g., temperature data, flow rate data), the received data can include a current data value (i.e., a most recent measurement) and at least one previous data value (i.e., at least one measurement that was measured before the most recent measurement was measured). The temperature data and flow rate data can be sampled at same frequency. Alternatively, temperature data and flow rate data can be sampled at different frequencies. The temperature data and flow rate data can be filtered before being received by the controller 108. The method 400 can include filtering the temperature data and/or the flow rate data to remove noise and/or anomalies from the data. The filtering can be done by a variety of known methods, such as via a bandpass filters, Fast-Fourier transforms, moving averages, or the like.

The method 400 can include determining 404 a change rate based on the difference between at least the current data value and at least one of the previous data values to determine a change rate. The current data value and the previous data value(s) can be data from the same sensor. Additionally or alternatively, the method 400 can include determining a change rate based on the difference in sensor data detected by a first sensor located at first location and sensor data detected by a second sensor located at a second location that is downstream the first location. For example, the method can include computing a change rate based on the difference between inlet temperature data from the inlet temperature sensor 111 and outlet temperature data from the outlet temperature sensor 115. That is, the method 400 can include calculating a rate of change between the temperature of fluid flowing into the heating device 106 (e.g., at the fluid inlet 110) and the temperature of fluid flowing out of the heating device (e.g., at the fluid outlet 114).

The method 400 can include comparing 408 the change rate to a predetermined threshold setting (i.e., comparing the change rate to the predetermined threshold setting). The predetermined threshold setting can be a predetermined value. The predetermined value can be unique to each water heater model and/or to each water heater. The predetermined threshold setting can be a flow rate threshold setting that can be used when monitoring flow rate data. Alternatively or in addition, the predetermined threshold setting can be a temperature change threshold setting that can be used when monitoring temperature data.

Additionally or alternatively, the method 400 can include normalizing the sensor data (e.g., temperature data, flow rate data) to determine normalized sensor data (e.g., normalized temperature data, normalized flow rate data) and calculating a derivative of the normalized sensor data to determine a normalized change rate. The normalization can be performed using feature scaling (e.g., mean normalization, min-max rescaling, z-score normalization and/or scaling to a unit basis). As non-limiting examples, the change rate can be normalized on a scale of 0 to 1, 0 to 100, or any other scale. The normalized change rate can be compared to a predetermined normalized threshold setting. As non-limiting examples, the predetermined normalized threshold settings can be approximately 50% of the normalized scale, approximately 70% of the normalized scale, approximately 75% of the normalized scale, approximately 80% of the normalized scale, approximately 85% of the normalized scale, approximately 90% of the normalized scale, or any other percentage of the normalized scale (e.g., any percentage between approximately 50% of the normalized scale and approximately 90% of the normalized scale, between approximately 60% of the normalized scale and approximately 80% of the normalized scale). The predetermined normalized threshold setting can be a predetermined value on the normalized scale and/or a predetermined percentage of the normalized scale. The method 400, include repeating the comparison of the change rate to the predetermined threshold setting once approximately every 0.1, 0.25, 0.5, 0.75 1, 2, 3, 4, 5, or 10 seconds while the fluid is flowing through the fluid inlet 110, the fluid outlet 114, and/or the heat exchanger 104.

The method 400 can include outputting 410 instructions to perform a corrective action in response to determining that the change rate exceeds (or alternatively, is greater than or equal to) the predetermined threshold setting (or determining the normalized change rate exceeds, or is greater than or equal to, a predetermined normalized threshold setting). The instructions associated with the corrective action can instruct the heating device 106 to decrease its heat output. For example, the instructions can instruct the heating device 106 to extinguish one or more burners (e.g., if the heating device is a staged burner device), reduce the flame height of one or more burners, deactivate one or more electric coils, reduce the duty cycle of the one or more electric coils, or perform any other action that would cause the heating device to decrease its heat output. Additionally or alternatively, the instructions to perform a corrective action can include instructions for the heating device 106 or a separate device to implement, insert, extend, or otherwise introduce a barrier or other heat transfer impediment that is configured reduce the transfer of heat from the heating device to the heat exchanger 104 and/or fluid. For example, the instructions can instruct the heating device 106 or another device to place a heat shield between the heating device 106 and the heat exchanger 104.

Should the heating device 106 include multiple burner stages (e.g., a staged burner) and/or multiple electric coils, the instructions can instruct the heating device 106 to extinguish, disengage, or deactivate a particular number of burner stages and/or coil elements. As a non-limiting example, the heating device 106 can be a staged burner having five stages. The method 400 can include outputting instructions for the staged burner to decrease the number of ignited stages, and the number by which the staged burned is instructed to decrease the number of ignited stages can depend, at least in part, on the number of stages currently firing. For example, if the staged burner is currently firing three or more stages, the instructions can instruct the burner to decrease the number of firing burners by two; if the staged burner is currently firing two stages, the instructions can instruct the burner to decrease the number of firing burners by one; and if the staged burner is currently firing one stage, the instructions can instruct the burner to continue firing the single or turn off all stages. If only a single stage is firing, the controller 108 can be configured to not transmit instructions to adjust the number of stages firing.

Additionally or alternatively, the controller 108 can be in communication with a valve and can instruct the valve to open and thereby release unheated fluid into the heat exchanger 104 and/or at or near the fluid outlet 114 (i.e., downstream of the heat exchanger 104) to mitigate a temperature overshoot event.

Any of the methods or processes disclosed herein (e.g., method 300, method 400) can be repeated in part or in full on a continuous or recurring basis. For example, the controller 108 can be configured to receive new sensor data on a continuous or recurring basis and can determine, based on the new sensor data, whether a corrective action (or an additional corrective action) should be performed or whether instructions should be outputted to maintain current settings. As a more specific example, the controller 108 can be configured to output instructions to reduce heat output (e.g., via a first corrective action), and if it is determined that the heat change rate is still above the predetermined threshold, the controller 108 can be configured to output instructions to perform a second correct action, such as further reducing the heat output.

Applicants performed testing to compare the disclosed technology to waters heaters omitting the disclosed technology. Under testing conditions, water heaters omitting the disclosed technology experienced in the range of approximately 15° F. to approximately 20° F., whereas temperature overshoot for systems including the disclosed technology was reduced to approximately 5° F. or less.

It is to be understood that the methods and processes described herein can be combined and/or modified without limitation. Any method step described above from one figure or process can be combined with the steps of another figure or process. Any of the methods and processes can also omit some of the steps described herein and/or include additional steps not shown in the figure.

The methods and computer-executable program instructions disclosed herein can be loaded onto a general-purpose computer, a special-purpose computer, a cloud computing network of remote servers, a processor, or other programmable data processing apparatus to produce a particular machine, such that the instructions that execute on the computer, processor, or other programmable data processing apparatus create means for implementing one or more functions specified in the flow diagram block or blocks. These computer program instructions can also be stored in a computer-readable memory that can direct a computer or other programmable data processing apparatus to function in a particular manner, such that the instructions stored in the computer-readable memory produce an article of manufacture including instruction means that implement one or more functions specified in the flow diagram block or blocks.

As an example, the disclosed technology can include a computer program product, including a computer-usable medium having a computer-readable program code or program instructions embodied therein, said computer-readable program code adapted to be executed to implement one or more functions specified in the flow diagram block or blocks. Likewise, the computer program instructions can be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, can be implemented by special-purpose, hardware-based computer systems that perform the specified functions, elements or steps, or combinations of special-purpose hardware and computer instructions.

While certain techniques and methods of the disclosed technology have been described in connection with what is presently considered to be the most practical implementations, it is to be understood that the disclosed technology is not to be limited to the disclosed implementations, but on the contrary, is intended to cover various modifications and equivalent arrangements included within the scope of the appended claims. Although specific terms are employed herein, they are used in a generic and descriptive sense only and not for purposes of limitation.

Although certain aspects of the disclosed technology have been described herein with respect to devices or systems, it is contemplated that actions, functions, aspects, and other capabilities of such devices or systems can be alternatively implements as methods and/or non-transitory computer-readable media. Likewise, although certain aspects of the disclosed technology have been described herein with respect to methods and/or non-transitory computer-readable media, it is contemplated that actions, functions, aspects, and other capabilities of such methods and/or non-transitory computer-readable media can be alternatively implements as devices or systems.

This written description uses examples to disclose certain implementations of the disclosed technology, including the best mode, and also to enable any person skilled in the art to practice certain implementations of the disclosed technology, including making and using any devices or systems and performing any incorporated methods. The patentable scope of certain implementations of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A controller for a water heater, the controller comprising:

one or more processors; and memory storing instructions that, when executed by the one or more processors, cause the controller to:

receive sensor data from a sensor of the water heater, the sensor data including a current data value and at least one previous data value;

determine a change rate based on a difference between at least the current data value and the at least one previous data value;

compare the change rate to a predetermined threshold setting at a predetermined interval throughout the time fluid is flowing through a fluid inlet, wherein the predetermined interval is no greater than 10 seconds; and output instructions to a heating device to perform a corrective action in response to determining that the change rate exceeds the predetermined threshold setting, the corrective action being a decrease from a first predetermined amount of heat output to a second predetermined amount of heat output, the second predetermined amount of heat output being nonzero.

2. The controller of claim 1, wherein comparing the change rate to the predetermined threshold setting comprises:

normalizing the sensor data to determine normalized sensor data;

calculating a derivative based on the normalized sensor data to determine a normalized change rate; and comparing the normalized change rate to a predetermined normalized threshold setting, wherein the instructions, when executed by the one or more processors, cause the controller to output the instructions to perform the corrective action in response to determining that the normalized change rate exceeds the predetermined normalized threshold setting.

3. The controller of claim 1, wherein:

the sensor is a flow rate sensor configured to detect flow of a fluid;

the sensor data is flow rate data; and the predetermined threshold setting is a predetermined flow rate threshold setting.

4. The controller of claim 1, wherein:

the sensor is a temperature sensor configured to detect fluid temperature of a fluid;

the sensor data being temperature data; and the predetermined threshold setting is a predetermined temperature threshold setting.

5. The controller of claim 1, wherein decreasing from the first predetermined amount of heat output to the second predetermined amount of heat output comprises one or more of: extinguishing one or more burners of a staged burner system or reducing a flame height of the one or more burners of the staged burner system.

6. The controller of claim 1, wherein decreasing from the first predetermined amount of heat output to the second predetermined amount of heat output comprises one or more of: deactivating one or more electric coils or reducing a duty cycle of the one or more electric coils.

7. The controller of claim 1, wherein the corrective action is performed within approximately 100 milliseconds or less.

8. A method for controlling a water heater, the method comprising:

receiving temperature data from a temperature sensor configured to measure fluid temperature at a fluid inlet;

receiving flow rate data from a flow rate sensor configured to measure a flow rate at the fluid inlet;

receiving a temperature setting;

calculating a heat load rate based on at least the temperature data, the flow rate data and the temperature setting;

comparing the heat load rate to a predetermined threshold setting at a predetermined interval throughout the time fluid is flowing through a fluid inlet, wherein the predetermined interval is no greater than 10 seconds; and outputting instructions to a heating device to perform a corrective action in response to determining that the heat load rate is greater than or equal to the predetermined threshold setting, the corrective action being a decrease from a first predetermined amount of heat output to a second predetermined amount of heat output, the second predetermined amount of heat output being nonzero.

9. The method of claim 8, wherein decreasing from the first predetermined amount of heat output to the second predetermined amount of heat output comprises one or more of: extinguishing one or more burners of a staged burner system or reducing a flame height of the one or more burners of the staged burner system.

10. The method of claim 8, wherein decreasing from heat output from the heating device comprises one or more of: deactivating one or more electric coils or reducing a duty cycle of the one or more electric coils.

11. The method of claim 8, wherein:

calculating the heat load rate comprises normalizing the temperature data and/or the flow rate data to determine a normalized heat load rate, and comparing the heat load rate to the predetermined threshold setting comprises comparing the normalized heat load rate to a predetermined normalized threshold setting.

12. The method of claim 8, wherein the corrective action is a first corrective action, the method further comprising:

receiving, from the temperature sensor, new temperature data;

receiving, from the flow rate sensor, new flow rate data;

calculating a new heat load rate based on the new temperature data, new flow rate data and the temperature setting;

comparing the new heat load rate to the predetermined threshold setting at a predetermined interval throughout the time fluid is flowing through a fluid inlet, wherein the predetermined interval is no greater than 10 seconds; and outputting instructions to the heating device to perform a second corrective action in response to the determination that the new heat load rate is less than the predetermined threshold setting, the second corrective action being an increase from the second predetermined amount of heat output to a third predetermined amount of heat output.

13. The method of claim 12, wherein the second corrective action includes one or more of: igniting one or more burners, increasing a flame height of the one or more burners, activating one or more electric coils, or increasing a duty cycle of the one or more electric coils.

14. The method of claim 8, wherein the corrective action is performed within approximately 100 milliseconds or less.

15. A tankless water heater comprising:

a water inlet;

one or more heating devices;

a temperature sensor configured to measure water temperature;

a flow rate sensor configured to measure water flow rate; and a controller comprising:

one or more processors; and memory storing instructions that, when executed by the one or more processors, cause the controller to:

receive temperature data from the temperature sensor, the temperature data indicative of a temperature of the water;

receive flow rate data from the flow rate sensor, the flow rate data indicative of a flow rate of the water;

receive a water temperature setting from a user interface device;

calculate a heat load rate based on at least the temperature data, the flow rate data, and the water temperature setting;

compare the heat load rate to a predetermined threshold setting at a predetermined interval throughout the time fluid is flowing through a fluid inlet, wherein the predetermined interval is no greater than 10 seconds; and output instructions to at least one of the one or more heating devices to perform a corrective action in response to determining that the heat load rate is greater than or equal to the predetermined threshold setting, the corrective action being a decrease from a first predetermined amount of heat output to a second predetermined amount of heat output, the second predetermined amount of heat output being nonzero.

16. The tankless water heater of claim 15, wherein the corrective action includes one or more of: extinguishing one or more burners, reducing a flame height of the one or more burners, deactivating one or more electric coils, or reducing a duty cycle of the one or more electric coils.

17. The tankless water heater of claim 15, wherein:

calculating the heat load rate comprises normalizing the temperature data and/or the flow rate data to determine a normalized heat load rate, and comparing the heat load rate to the predetermined threshold setting comprises comparing the normalized heat load rate to a predetermined normalized threshold setting.

18. The tankless water heater of claim 15, wherein the corrective action is a first corrective action and the controller further comprises instructions configured to:

receive new temperature data from the temperature sensor;

receive new flow rate data from the flow rate sensor;

calculate a new heat load rate based on at least the new temperature data, the new flow rate data, and the temperature setting; and output instructions to at least one of the one or more heating devices perform a second corrective action in response to determining that the new heat load rate is greater than or equal to the predetermined threshold setting, the second corrective action being a decrease from the second predetermined amount of heat output to a third predetermined amount of heat output.

19. The tankless water heater of claim 18, wherein the second corrective action includes one or more of: extinguishing one or more burners, reducing a flame height of the one or more burners, deactivating one or more electric coils, or reducing a duty cycle of the one or more electric coils.

20. The tankless water heater of claim 18, wherein second corrective action further comprises increasing fluid flow rate through the water inlet.

* * * * *